US006295835B1

(12) United States Patent
Le Bot

(10) Patent No.: US 6,295,835 B1
(45) Date of Patent: Oct. 2, 2001

(54) PROCESS FOR AIR SEPARATION BY CRYOGENIC DISTILLATION

(75) Inventor: Patrick Le Bot, Vincennes (FR)

(73) Assignee: L'Air Liquide Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/495,701

(22) Filed: Feb. 1, 2000

(30) Foreign Application Priority Data

Feb. 1, 1999 (FR) ..... 99 01097

(51) Int. Cl.[7] ..... F25J 3/00; F25J 5/00

(52) U.S. Cl. ..... 62/641; 62/642; 62/908; 62/909

(58) Field of Search ..... 62/617, 640, 641, 62/642, 643, 644, 902, 903, 908, 909

(56) References Cited

U.S. PATENT DOCUMENTS

| | | | | |
|---|---|---|---|---|
| 4,034,420 | * | 7/1977 | Gotoh et al. | 165/1 |
| 4,131,155 | * | 12/1978 | Thorogood | 165/1 |
| 4,459,143 | * | 7/1984 | Nawata et al. | 62/641 |
| 5,471,843 | | 12/1995 | Chretien . | |
| 5,740,683 | * | 4/1998 | Billingham et al. | 62/644 |
| 5,778,700 | | 7/1998 | Lee et al. | 62/656 |
| 5,802,872 | | 9/1998 | Billingham et al. | 62/641 |

FOREIGN PATENT DOCUMENTS

| | | | | |
|---|---|---|---|---|
| 785475 | * | 5/1968 | (CA) | 62/641 |
| 1117616 | | 11/1961 | (DE) . | |
| 0 531 182 | | 3/1993 | (EP) . | |
| 0 698 772 | | 2/1996 | (EP) . | |
| 0 757 217 | | 2/1997 | (EP) . | |
| 1.426.146 | | 4/1966 | (FR) . | |
| WO 87/00609 | | 1/1987 | (WO) . | |

* cited by examiner

*Primary Examiner*—William Doerrler
(74) *Attorney, Agent, or Firm*—Young & Thompson

(57) ABSTRACT

In a process for separating air in a plant comprising at least two columns (1, 3), some of the air (100) at an intermediate pressure is cooled in at least one passage of a heat-exchange system which is or are regenerated by a gas from the plant (17, 21) which may contain at least 50% oxygen.

The rest of the air at the medium pressure (200) is either purified outside the heat-exchange system or sent to a passage which is purified in the same way.

22 Claims, 4 Drawing Sheets

PROCESS FOR AIR SEPARATION BY CRYOGENIC DISTILLATION

The present invention relates to a process and to a plant for air separation by cryogenic distillation.

In particular, it relates to processes for producing oxygen gas containing between 60 and 96 mol. % oxygen.

It is known from EP-A-229803 and US-A-4022030 to use a mixing-column process to produce impure oxygen under pressure. Variants of this process, such as those described in EP-A-531182, use different operating pressures in the medium-pressure and mixing columns, and operate the mixing column at a pressure below or above that of the medium-pressure column. The air feeding the base of the mixing column can hence come from an intermediate stage of the main air compressor; in this case, two drying/decarbonating systems are necessary, one on each of the air streams.

Alternatively, the air may come from the exhaust of an expansion turbine, as described in EP-A-698772: in this case, there is either a minimum oxygen pressure or a minimum liquid production for the assembly to be energetically optimal.

US-A-5802872 describes the use of a brazed-plate exchanger and a reversible exchanger to cool the air intended for the medium-pressure column of a double column.

WO-A-99/42773, published on Aug. 26, 1999, describes a process in which between 50 and 80% of the air intended for an air separation unit is purified with respect to water in regenerators, and the rest of the air is purified by adsorption.

One object of the invention is to reduce the investment costs of impure-oxygen production units.

According to one subject of the invention, a process is provided for air separation in an air separation plant comprising at least two air distillation columns, including a medium-pressure column and a low-pressure column, in which:

a) a first compressed air flow is cooled in one or more first passage or passages of a heat-exchange system b) a second compressed air flow is cooled in one or more second passage or passages of the heat-exchange system c) at least one gas flow coming from a column of the plant is warmed in one or more third passage or passages of the heat-exchange system, characterized in that at least some of the gas flow coming from the plant is sent periodically and cyclically to the first passage or passages in order to regenerate the first passage or passages, and the first air flow is then returned to the/at least one of the third passage or passages of the heat-exchange system, which is or are free from the gas coming from the plant and is or are substantially without any impurities.

The first air flow is hence cooled periodically and cyclically in at least one first passage of the system and in at least one third passage of the system. If the first air flow is cooled in at least one first passage of the system, the gas coming from a column of the plant is warmed in at least one of the third passages. If the first air flow is cooled in at least one third passage of the system, at least some of the gas coming from a column of the plant regenerates the first passage or passages and no longer circulates in at least some of the third passages.

However, if only some of the gas is used to regenerate the first air passages, the rest of the gas may be warmed in the third passage or passages which is or are not used by the air.

It will be understood that the heat-exchange system may include a single exchange line or may comprise two separate exchange lines, including a first in which the first compressed air flow is cooled and a second in which the second compressed air flow is cooled. At least one of the third passages (or the third passage) in which the gas flow coming from the plant is warmed is located in the first exchange line. Optionally, at least one of the third passages, in which the gas flow coming from the plant is warmed, may be located in the second exchange line.

In the case in which only some of the gas is used to regenerate the first air passages, only this regenerating gas is sent to the first exchange line, it being possible for the rest of the gas to be warmed in the third passage or passages situated in the second exchange line.

Preferably, the first flow is sent to the heat-exchange system at a pressure below that at which the second flow enters.

The first flow rate may be less than the second flow rate, and preferably constitutes between 3 and 50% of the total air flow rate sent to the plant, in particular between 10 and 40% of the total flow rate.

At least some of the first air flow cooled in the exchanger may feed a column operating at a pressure at least 0.5 bar lower than the medium pressure.

According to a variant, the column operating at a pressure at least 0.5 bar lower than the medium pressure is a mixing column, a column operating at a pressure intermediate to the medium and low pressure or at the pressure of the low pressure column.

Preferably, a nitrogen-enriched residual gas from the low-pressure column and/or an oxygen-enriched gas from the mixing column or the low-pressure column and/or an argon-enriched gas from an argon column is warmed periodically and cyclically in the first passage where the first flow is cooled.

At least some of the first air flow may be withdrawn at an intermediate point of the exchange system, instead of at its cold end.

Either only the second air flow (not the first flow) is purified with respect to water and $CO_2$, for example by adsorbent beds, before being cooled in the exchanger, or the second passage or passages is or are also regenerated by a gas coming from the plant substantially without any impurities, for example impure nitrogen from the low-pressure column. In this case, the purification upstream of the heat-exchange system may be dispensed with completely or partially.

In certain cases, the impure oxygen gas containing between 50 and 96 mol. % oxygen could be used to regenerate the first passage or passages and/or the second passage or passages and be used as a product while containing water and $CO_2$. For example, a gas having this composition can feed a blast furnace. The impure oxygen is hence not wasted.

According to another subject of the invention, a plant is provided for air separation by cryogenic distillation, comprising:

at least two columns, including a medium-pressure column and a low-pressure column, a heat-exchange system, means for sending a first air flow to one/some first passage or passages of the heat-exchange system without purifying it before it enters the heat-exchange system, means for sending a second air flow to one/some second passage or passages of the heat-exchange system, means for sending a gas from the plant to one/some third passage or passages of the heat-exchange system where it is warmed, characterized in that it comprises means for sending at least some of the gas from the plant to the first passage or passages in order to regenerate it cyclically, and means for sending the first air flow to the third passage/to at least one of the third passages.

Preferably, it comprises a mixing column, means for sending oxygen-rich liquid from the low-pressure column to the mixing column, and means for sending air from the heat-exchange system to the mixing column.

At least some of the required cooling power may be produced by a blower turbine fed with air from the exchanger.

According to a variant, there are means for sending impure oxygen to the first passage or passages as a regenerating gas, coming optionally from the mixing column or the low-pressure column.

There are either means for purifying the second air flow before sending it to the exchanger, or means for sending the gas from the plant to the second passage or passages in order to regenerate it, and not comprising means for purifying the second air flow entirely before sending it to the exchanger.

The invention will now be described in more detail with reference to FIGS. 1, 2, 3 and 4, which are diagrams of plants according to the invention.

In order to simplify the description, it will be assumed here that there is only a single first air passage and a single second air passage. In reality, that will probably be several passages fulfilling the role of first passages, and several passages fulfilling the role of second passages.

The process of FIG. 1 makes it possible to produce oxygen gas by a mixing-column process in which the operating pressure of the mixing column 5 is lower than the operating pressure of the MP column 1.

The plant comprises a medium-pressure column 1, a low-pressure column 3 thermally connected to the latter, and a mixing column 5.

The air 100 constituting between 30 and 50% of the air feeding the mixing column 5 is compressed to a level close to the delivery pressure of the oxygen 21 in the compressor 7.

The rest of the air to be distilled 200, constituting between 40% and 60% of the air is boosted at 7 to a value close to the operating pressure of the medium-pressure column 1.

The said air flow 100 is introduced directly into a first passage A forming part of the main exchange line 11, without being treated beforehand in a decarbonating/drying system.

As described above, this first passage A (or these first passages) and the third passage C may in fact be located in one exchanger, and the second passage B and the third passage D may be located in another exchanger.

In a first phase, the valves 1A, 1C, 2D, 2B are opened and the valves 1B, 1D, 2A, 2C are closed, and the air is cooled in the first passage or passages A before being sent to the base of the mixing column 5.

The residual gas 17 is divided into two parts. A first part is sent to a third passage of the exchange system C (third passages of the exchange system) and the rest is sent to another third passage D of the exchange system (other passages of the exchange system) in a first phase.

In a second phase, the valves 1A, 1C, 2D, 2B are closed and the valves 1B, 1D, 2A, 2C are opened, and the first part of the residual gas, constituting between 30 and 40% of the air sent to the unit, is sent to the first passages A, which are normally occupied by the air which is being cooled, and the rest of the residual gas is still sent to the same passages D as in normal running. In general, the number of passages C will be equal to the number of passages A.

At the same time, the air intended for the mixing column is sent to the third passage C (third passages) freed by the residual gas.

Once the passages A have been regenerated by the residual gas, the system returns to the first phase and the air is cooled as before in the first passage or passages A before being sent to the base of the mixing column 5.

The residual gas 17 is divided into two parts. Once again, a first part is sent to a third passage of the exchange system C (third passages of the exchange system) and the rest is sent to another third passage D of the exchange system (other passages D of the exchange system).

Hence, in the first phase, the residual gas will be used to regenerate the third passages C in which the air has circulated during the second phase.

The means needed for sending the air either to the passages A in the first phase or to the passages C in the second phase, and for sending the residual gas to the passages D continuously and either to the passages C in the first phase or to the passages A in the second phase, are illustrated and are well-known to the person skilled in the art of reversible exchangers—a subject which is dealt with, for example, in "Tieftemperaturtechnik" by Hausen and Linde.

The circuits A of the exchange line which are dedicated to this untreated air, and in which the water vapor and the dry ice are therefore deposited, are regenerated cyclically by one of the gases output by the distillation or mixing columns, and are hence substantially without impurities (that is to say free from water and $CO_2$) (system of reversible exchangers). In the example, a residual gas from the low-pressure column 3 may be sent either to regenerate the first passage of the exchanger or to a third passage where it is warmed. While the regenerating gas is circulating in the first passage, the first air flow is cooled in the third passage.

Preferably, at least one third passage C will form part of the first exchanger where the first air flow is cooled, and at least one third passage D will form part of the second exchanger where the second air flow is cooled.

Hence, the third passages D which are always fed with residual gas may be in the second exchanger, while those C which receive air in a purification phase may be in the first exchanger (see broken line in FIGS. 1 and 2).

The air feeding the MP column is purified either by a drying/decarbonating system 13 or also by regenerating the second passage with a residual gas from the low-pressure column (impure oxygen or nitrogen).

The air purified in the purifier 13 is partially cooled in the second passage or second passages B, some is withdrawn from the exchanger, expanded in a blower turbine 15 and sent to the low-pressure column 3; the rest of the air continues to be cooled in the second passage and is sent to the medium-pressure column 1.

Liquid oxygen, pumped to a pressure lower than the medium pressure, feeds the head of the mixing column 5. Impure oxygen gas containing between 60 and 96 mol. % oxygen is withdrawn from the head of the mixing column and is sent to the heat-exchange system 11, or to the second exchanger if there is one, where it is warmed.

An intermediate liquid and a base liquid from the mixing column are sent to the medium-pressure column.

Rich liquid is sent from the medium-pressure column to the low-pressure column at the same level as the air from the blower turbine.

Lean liquid is sent from the head of the medium-pressure column to the head of the low-pressure column.

In the variant of FIG. 2, the first passage A is regenerated with all or some of the gas withdrawn at the head of the mixing column, which contains at least 50% oxygen and preferably 80% oxygen, which may be sent either to regenerate the first passage of the exchanger or to a third passage where it is warmed. While the regenerating gas is circulating in the first passage (or the first passages), the first air flow is cooled in the third passage (or the third passages).

After the regeneration, the humid impure oxygen fraction containing $CO_2$ is mixed with the rest of the gas and sent to a blast furnace or other plant consuming humid impure oxygen.

There are therefore preferably at least two third passages, at least in the case of FIG. 1. Preferably, at least one third passage will form part of the first exchanger where the first air flow is cooled, and at least one third passage will form part of the third exchanger where the second air flow is cooled.

In FIGS. 3 and 4, the first air flow is withdrawn from the exchanger 11A upstream of its cold end.

Figure 1:
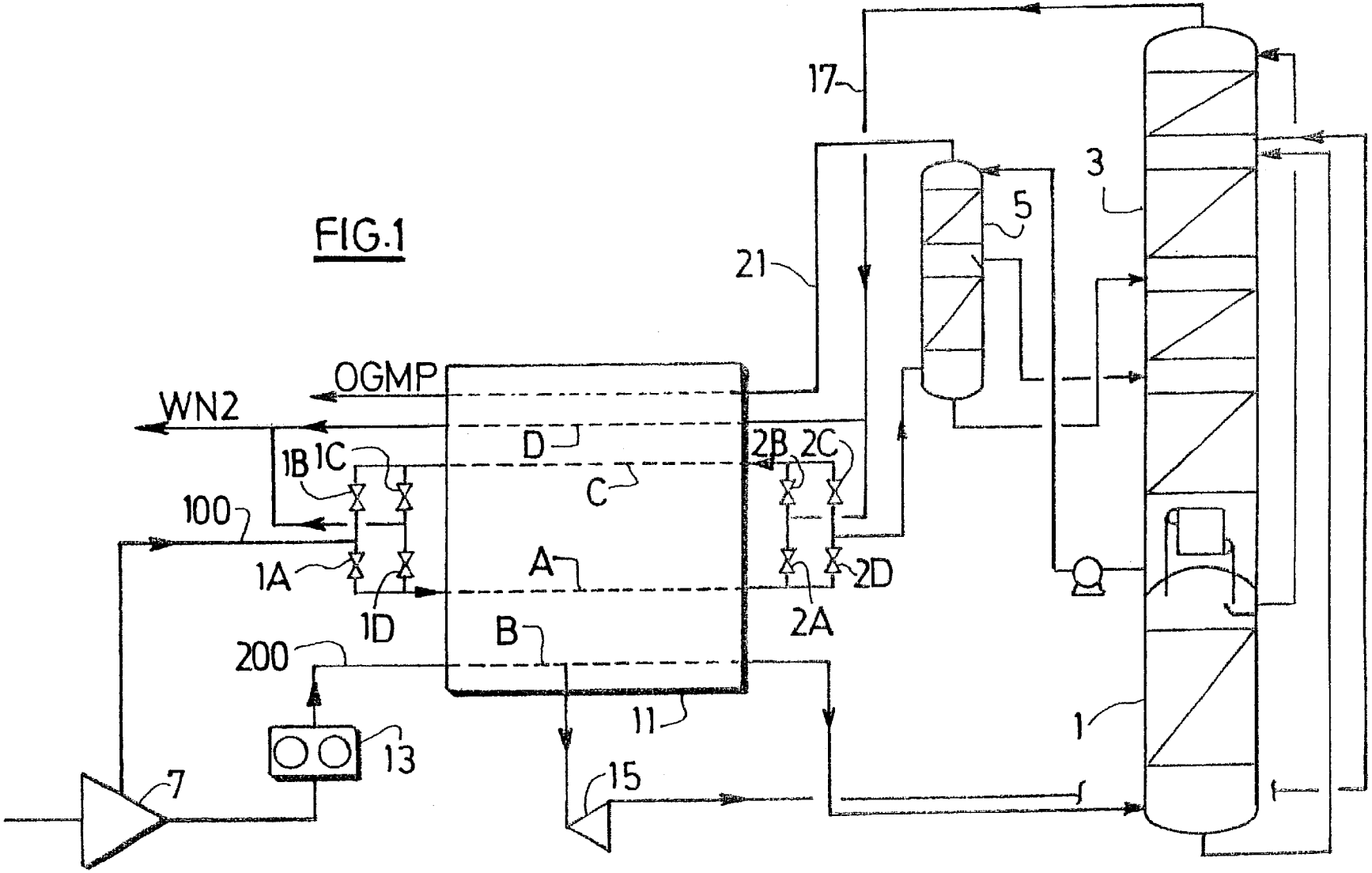
Figure 2:
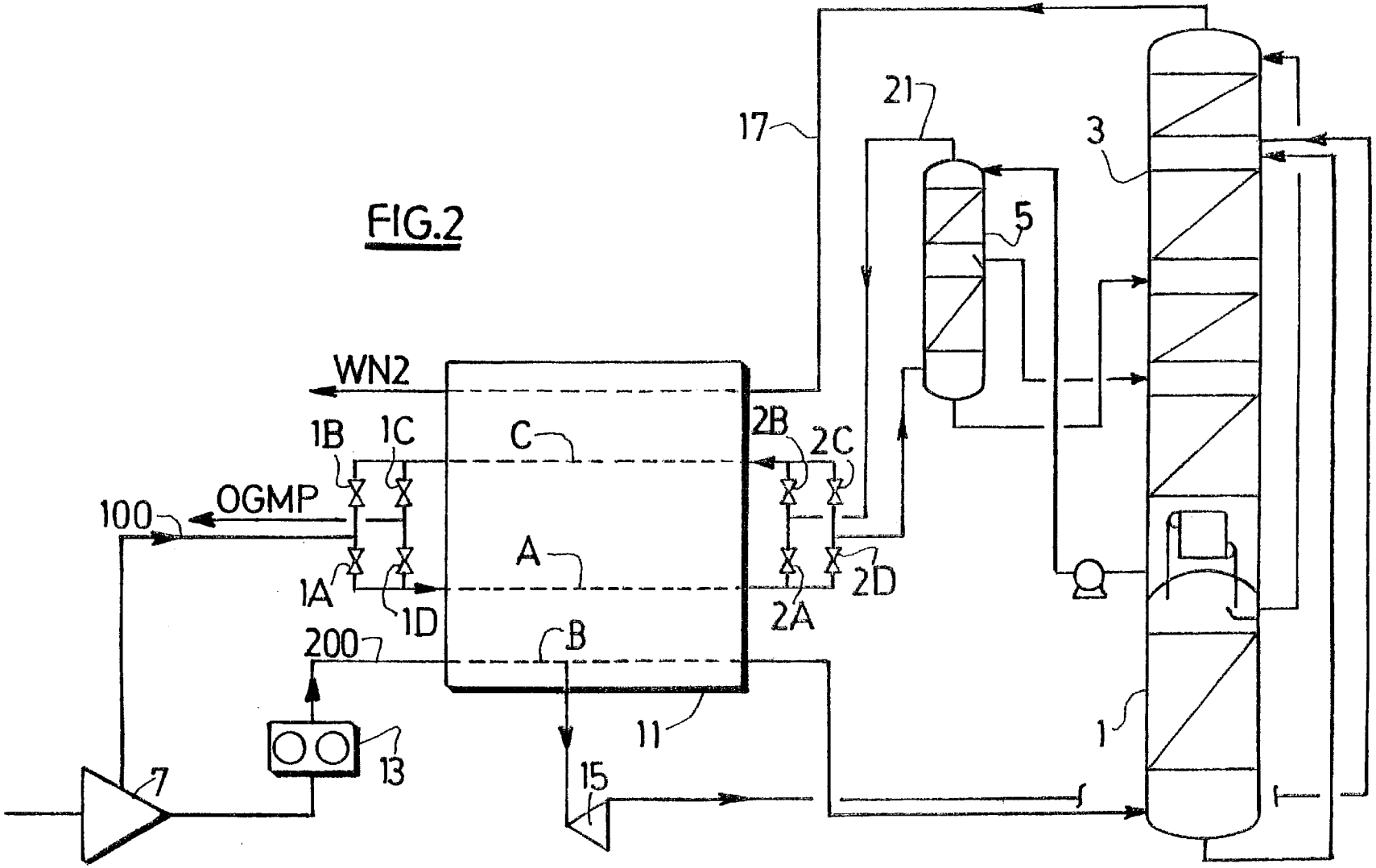
Figure 3:
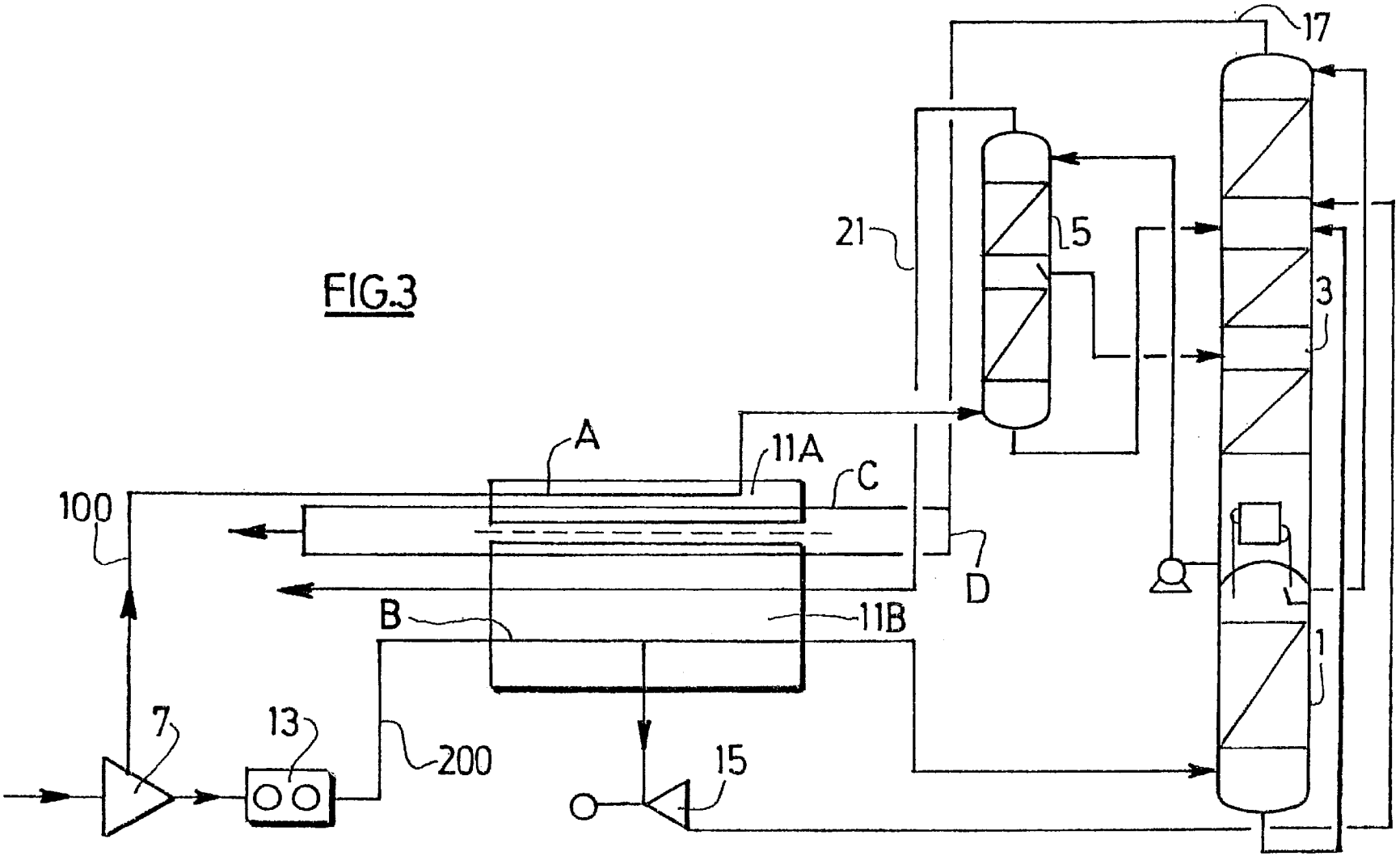
FIG. 3 shows a simplified version of FIG. 1, in which the first passages A and the third passages C are located in an exchanger 11A, and the second passages B, the passages for warming oxygen gas 21 and the third passages D are located in an exchanger 11B.
Figure 4:
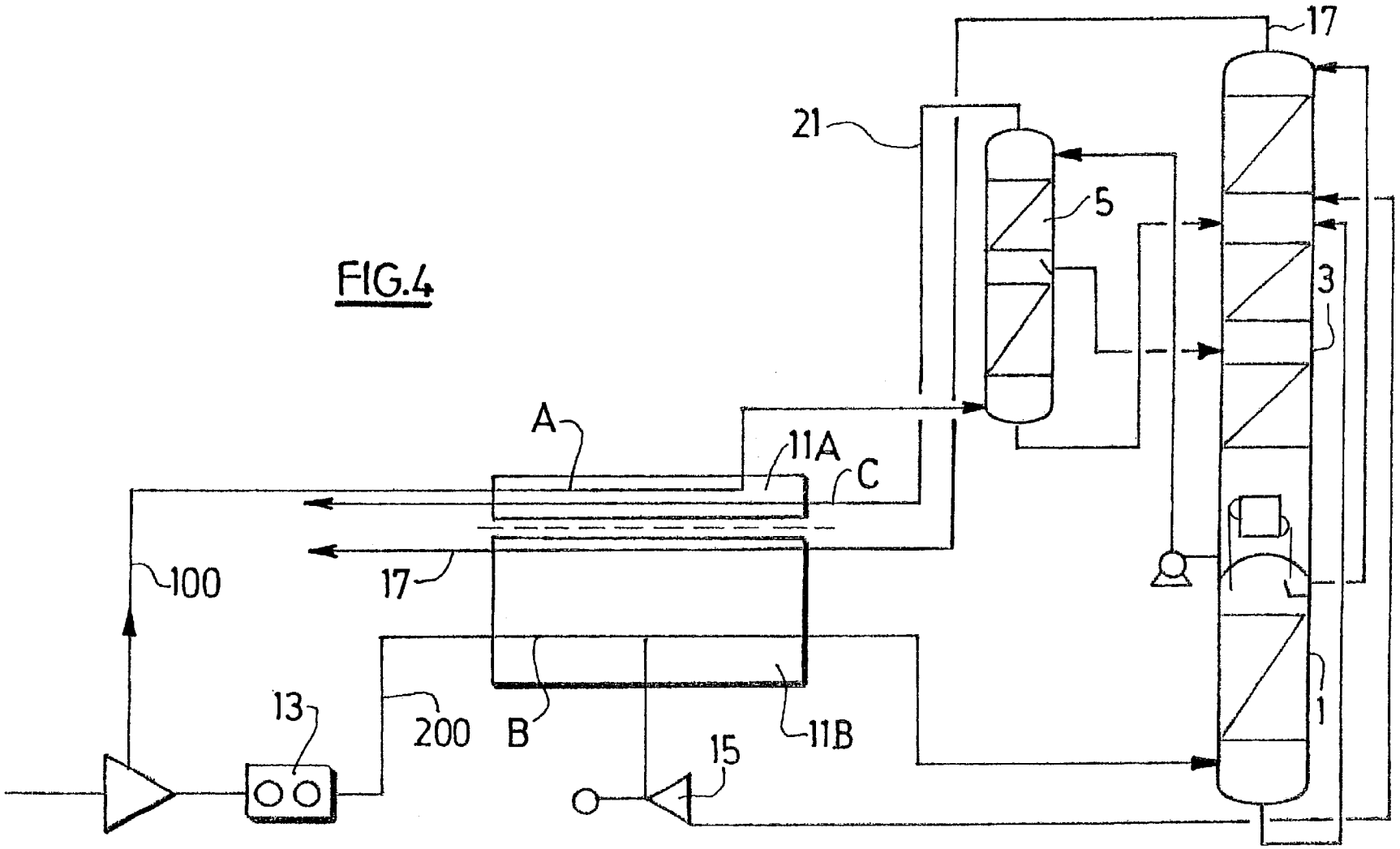
FIG. 4 shows a simplified version of FIG. 2, in which the first passages A and the third passages C are located in an exchanger 11A, and the second passages and the passages for warming the residual gas 17 from the low-pressure column are located in an exchanger 11B. The valve systems of FIGS. 3 and 4 are not shown in detail.

The following modifications may be envisaged, inter alia:

- production of some of the oxygen at a purity of more than 98 mol. % from the low-pressure column, in liquid or gas form, under pressure or not under pressure
- use of a Claude turbine or nitrogen turbine, optionally producing at least one liquid fraction
- operation of the low-pressure column at a pressure above 1.5 bar
- use of one or more argon columns fed from the low-pressure column; in this case, at least some of the regenerating gas may consist of an argon-enriched gas
- production of liquid as a final product
- vaporization of a liquid from the column or from an external source in the exchange line
- operation of the mixing column at a pressure equal to or above the medium pressure
- use of the gas which has regenerated the first or second passage as a product, for example humid impure oxygen
- expansion of air intended for the mixing column in a turbine.

The air sent to the mixing column does not necessarily come from the same compressor as the air intended for the medium-pressure column.

In particular, one of the flows may come from the fan of a blast furnace or the compressor of a gas turbine or another source of compressed air.

The invention is not restricted to systems comprising a mixing column.

The first air flow may, for example, be intended for the low-pressure or intermediate-pressure column of a triple column of the Etienne or Ha type.

What is claimed is:

1. Process for air separation in an air separation plant comprising at least two distillation columns (1, 3, 5), including a medium-pressure column (1) and a low-pressure column (3), in which, in a first phase:

a) a first compressed air flow (100) is cooled in at least one first passage (A) of a heat-exchange system (11)

b) a second compressed air flow (200 is cooled in at least one second passage (B) of the heat-exchange system c) a gas flow (17, 21) coming from the plant is warmed in at lest one third passage (C, D) of the heat-exchange system characterized in that:

at least some of the gas flow coming from the plant is sent periodically and cyclically in a second phase to the first passage or passages in order to regenerate it or them, the first air flow is then returned to the/at least one of the third passage or passages (C) of the heat-exchange system, which is or are then free from the gas coming from the plant and is or are substantially without any impurities, and the first air flow (100) is sent to the heat-exchange system (11, 11A) at a pressure lower than that at which the second flow (200) enters the second exchanger.

2. Process according to claim 1, in which at least some of the first air flow cooled in the exchanger feeds a column (5) operating at a pressure at least 0.5 bar lower than the medium pressure (1).

3. Process according to claim 2, in which the column (5) operating at a pressure at least 0.5 bar lower than the medium pressure is a mixing column operating at a pressure intermediate to the medium and low pressure or operating at the pressure of the low-pressure column.

4. Process according to claim 1, in which, during the second phase, a nitrogen-enriched gas from the low-pressure or medium-pressure column and/or an oxygen-enriched gas coming from the mixing column and/or an argon-enriched gas coming from an argon column is warmed in the first passage or passages (A) where the first flow (100) is cooled in the first phase.

5. Process according to claim 1, in which at least some of the first air flow is withdrawn at an intermediate point of the heat-exchange system (11).

6. Process according to claim 1, in which the second passage or passages (B) is or are regenerated during the second phase by one or more gases coming from the plant.

7. Process according to claim 6, in which the second passage or passages is or are regenerated by a nitrogen-enriched gas from the medium- or low-pressure column.

8. Process according to claim 6, in which the second passage or passages (B) is or are regenerated by an oxygen-enriched gas from a mixing column or the low-pressure column.

9. Process according to claim 1, in which, during the second phase, some of the gas coming from the plant is sent to at least one of the third passages (D) and at least some of the same gas is sent to the first passage or passages.

10. Plant for air separation by cryogenic distillation, comprising:

at least two columns (1, 3, 5), including a medium-pressure column and a low-pressure column, a heat-exchange system (11), means (1A to 1D, 2A to 2D) for sending, in a first phase, a first air flow at a first pressure to one/some first passage or passages (A) of the heat-exchange system without purifying it before it enters the heat-exchange system, means for sending a second air flow at a second pressure higher than said first pressure to one/some second passage or passages (B) of the heat-exchange system, means (1A to 1D, 2A to 2D) for sending at least one gas from a column of the plant to one/some third passage or passages (C, D) of the heat-exchange system, characterized in that it comprises means (1A to 1D, 2A to 2D) for sending the gas from the plant to the first passage or passages (A) in a second phase in order to regenerate it cyclically, and means (1A to 1D, 2A to 2D) for sending the first air flow to the third passage/to at least one of the third passages (C) in the second phase.

11. Plant according to claim 10, comprising a means for sending the gas from the plant to the second passage in order to regenerate it, and not comprising means for purifying the second air flow before sending it to the heat-exchange system.

12. Process for air separation by cryogenic distillation in an air separation plant comprising at least two columns (1, 3, 5), in which a compressed air flow containing water and carbon dioxide is cooled in one or more first passage or passages of a heat-exchange system, a gas flow comprising at least 50 mol % oxygen coming from a column (3, 5) of the plant is warmed in another or some other passage or passages of the heat-exchange system, characterized in that the first passage or passages is or are regenerated by sending at least some of the gas flow comprising at least 50% oxygen to it or them, and the gas flow contains at least 80 mol. % oxygen.

13. Plant for air separation by cryogenic distillation, comprising at least one distillation column (1, 3, 5), a heat-exchange system (11), means for sending air comprising water and carbon dioxide to one or more first passage or passages (A), means for sending a gas containing at least 80 mol % oxygen coming from a column of the plant to one or more second passage or passages (B), characterized in that it comprises means for sending a gas containing at least 80 mol % oxygen coming from one or more columns to the passage or passages where the air is cooled in order to regenerate it, and means for sending the air to the second passage or at least one of the other passages.

14. Process for air separation in an air separation plant comprising at least two distillation columns (1, 3, 5), including a medium-pressure column (1) and a low-pressure column (3), in which, in a first phase:

a) a first compressed air flow (100) is cooled in at least one first passage (A) of a heat-exchange system (11)

b) a second compressed air flow (200 is cooled in at least one second passage (B) of the heat-exchange system c) a gas flow (17, 21) coming from the plant is warmed in at lest one third passage (C, D) of the heat-exchange system characterized in that:

at least some of the gas flow coming from the plant is sent periodically and cyclically in a second phase to the first passage or passages in order to regenerate it or them, the first air flow is then returned to the/at least one of the third passage or passages (C) of the heat-exchange system, which is or are then free from the gas coming from the plant and is or are substantially without any impurities, and at least some of the first air flow (100) feeds a column (5) operating at a pressure at least 0.5 bar higher than the medium pressure.

15. Process according to claim 14, in which the column (5) operating at a pressure at least 0.5 bar higher than the medium pressure is a mixing column.

16. Process for air separation in an air separation plant comprising at least two distillation columns (1, 3, 5), including a medium-pressure column (1) and a low-pressure column (3), in which, in a first phase:

a) a first compressed air flow (100) is cooled in at least one first passage (A) of a heat-exchange system (11)

b) a second compressed air flow (200 is cooled in at least one second passage (B) of the heat-exchange system c) a gas flow (17, 21) coming from the plant is warmed in at lest one third passage (C, D) of the heat-exchange system characterized in that:

at least some of the gas flow coming from the plant is sent periodically and cyclically in a second phase to the first passage or passages in order to regenerate it or them, the first air flow is then returned to the/at least one of the third passage or passages (C) of the heat-exchange system, which is or are then free from the gas coming from the plant and is or are substantially without any impurities, and only the second air flow (200) is at least partially purified with respect to water and $CO_2$ before being cooled in the exchanger.

17. Plant for air separation by cryogenic distillation, comprising:

at least two columns (1, 3, 5), including a medium-pressure column and a low-pressure column, a heat-exchange system (11), means (1A to 1D, 2A to 2D) for sending, in a first phase, a first air flow to one/some first passage or passages (A) of the heat-exchange system without purifying it before it enters the heat-exchange system, means for sending a second air flow to one/some second passage or passages (B) of the heat-exchange system, means (1A to 1D, 2A to 2D) for sending at least one gas from a column of the plant to one/some third passage or passages (C, D) of the heat-exchange system, characterized in that it comprises means (1A to 1D, 2A to 2D) for sending the gas from the plant to the first passage or passages (A) in a second phase in order to regenerate it cyclically, and means (1A to 1D, 2A to 2D) for sending the first air flow to the third passage/to at least one of the third passages (C) in the second phase, and a mixing column (5) and means for sending air from the heat-exchange system to the mixing column.

18. Plant for air separation by cryogenic distillation, comprising:

at least two columns (1, 3, 5), including a medium-pressure column and a low-pressure column, a heat-exchange system (11), means (1A to 1D, 2A to 2D) for sending, in a first phase, a first air flow to one/some first passage or passages (A) of the heat-exchange system without purifying it before it enters the heat-exchange system, means for sending a second air flow to one/some second passage or passages (B) of the heat-exchange system, means (1A to 1D, 2A to 2D) for sending at least one gas from a column of the plant to one/some third passage or passages (C, D) of the heat-exchange system, characterized in that it comprises means (1A to 1D, 2A to 2D) for sending the gas from the plant to the first passage or passages (A) in a second phase in order to regenerate it cyclically, and means (1A to 1D, 2A to 2D) for sending the first air flow to the third passage/to at least one of the third passages (C) in the second phase, and a blower turbine (15) fed with air from the second passage or passages of the heat-exchange system.

19. Plant for air separation by cryogenic distillation, comprising:

at least two columns (1, 3, 5), including a medium-pressure column and a low-pressure column, a heat-exchange system (11), means (1A to 1D, 2A to 2D) for sending, in a first phase, a first air flow to one/some first passage or passages (A) of the heat-exchange system without purifying it before it enters the heat-exchange system, means for sending a second air flow to one/some second passage or passages (B) of the heat-exchange system, means (1A to 1D, 2A to 2D) for sending at least one gas from a column of the plant to one/some third passage or passages (C, D) of the heat-exchange system, characterized in that it comprises means (1A to 1D, 2A to 2D) for sending the gas from the plant to the first passage or passages (A) in a second phase in order to regenerate it cyclically, and means (1A to 1D, 2A to 2D) for sending the first air flow to the third passage/to at least one of the third passages (C) in the second phase, and the oxygen-enriched gas comes from a mixing column or the low-pressure column.

20. Plant for air separation by cryogenic distillation, comprising:

at least two columns (1, 3, 5), including a medium-pressure column and a low-pressure column, a heat-exchange system (11), means (1A to 1D, 2A to 2D) for sending, in a first phase, a first air flow to one/some first passage or passages (A) of the heat-exchange system without purifying it before it enters the heat-exchange system, means for sending a second air flow to one/some second passage or passages (B) of the heat-exchange system, means (1A to 1D, 2A to 2D) for sending at least one gas from a column of the plant to one/some third passage or passages (C, D) of the heat-exchange system, characterized in that it comprises means (1A to 1D, 2A to 2D) for sending the gas from the plant to the first passage or passages (A) in a second phase in order to regenerate it cyclically, and means (1A to 1D, 2A to 2D) for sending the first air flow to the third passage/to at least one of the third passages (C) in the second phase, and means (13) for at least partially purifying the second air flow before sending it to the heat-exchange system.

21. Plant for air separation by cryogenic distillation, comprising:

at least two columns (1, 3, 5), including a medium-pressure column and a low-pressure column, a heat-exchange system (11), means (1A to 1D, 2A to 2D) for sending, in a first phase, a first air flow to one/some first passage or passages (A) of the heat-exchange system without purifying it before it enters the heat-exchange system, means for sending a second air flow to one/some second passage or passages (B) of the heat-exchange system, means (1A to 1D, 2A to 2D) for sending at least one gas from a column of the plant to one/some third passage or passages (C, D) of the heat-exchange system, characterized in that it comprises means (1A to 1D, 2A to 2D) for sending the gas from the plant to the first passage or passages (A) in a second phase in order to regenerate it cyclically, and means (1A to 1D, 2A to 2D) for sending the first air flow to the third passage/to at least one of the third passages (C) in the second phase, and the heat-exchange system (11) comprises a first heat exchanger (11A) comprising at least the first passage or passages and the third passage/at least some of the third passages, and a second heat exchanger (11B) comprising at least the second passage or passages and other passages in which fluids coming from at least one column of the plant are warmed.

22. Plant according to claim 21, in which the second exchanger (11*b*) comprises some of the third passages (D).

* * * * *